US008875716B2

(12) United States Patent
Norström et al.

(10) Patent No.: US 8,875,716 B2
(45) Date of Patent: Nov. 4, 2014

(54) ORAL SMOKELESS TOBACCO PRODUCTS AND ORAL SMOKELESS NON-TOBACCO SNUFF PRODUCTS COMPRISING CARBAMIDE OR CARBAMIDE SALTS

(75) Inventors: Herman Norström, Gothenburg (SE); Dowen Birkhed, Gothenburg (SE)

(73) Assignee: Swedish Match North Europe AB, Stockholm (SE)

( * ) Notice: Subject to any disclaimer, the term of this patent is extended or adjusted under 35 U.S.C. 154(b) by 0 days.

(21) Appl. No.: 13/579,381

(22) PCT Filed: Feb. 15, 2011

(86) PCT No.: PCT/SE2011/050162

§ 371 (c)(1), (2), (4) Date: Nov. 5, 2012

(87) PCT Pub. No.: WO2011/102788

PCT Pub. Date: Aug. 25, 2011

(65) Prior Publication Data

US 2013/0053603 A1 Feb. 28, 2013

Related U.S. Application Data

(60) Provisional application No. 61/305,432, filed on Feb. 17, 2010.

(30) Foreign Application Priority Data

Feb. 17, 2010 (SE) ..... 1000154

(51) Int. Cl.

| | |
|---|---|
| ***A24B 15/00*** | (2006.01) |
| ***A24B 15/28*** | (2006.01) |
| ***A24B 13/00*** | (2006.01) |
| ***A24B 15/30*** | (2006.01) |

(52) U.S. Cl.

CPC ..... *A24B 13/00* (2013.01); *A24B 15/287* (2013.01); *A24B 15/30* (2013.01)

USPC ..... 131/352

(58) Field of Classification Search

USPC ..... 131/352, 359

See application file for complete search history.

(56) References Cited

U.S. PATENT DOCUMENTS

| | | | | |
|---|---|---|---|---|
| 3,067,068 | A * | 12/1962 | Finberg | 131/359 |
| 3,934,594 | A * | 1/1976 | Beringer et al. | 131/359 |
| 5,470,566 | A | 11/1995 | Lutzen | |
| 2004/0091432 | A1 | 5/2004 | Dulin | |
| 2008/0292765 | A1 * | 11/2008 | Prakash et al. | 426/548 |

FOREIGN PATENT DOCUMENTS

| | | |
|---|---|---|
| GB | 1352663 | 5/1974 |
| GB | 2064294 | 6/1981 |
| WO | 2009048522 A1 | 4/2009 |

OTHER PUBLICATIONS

International Search Report dated Mar. 30, 2011, corresponding to PCT/SE2011/050162.

Biosis Abstract EMB-0007055971, Oral Surgery Oral Medicine and Oral Pathology, 1949, pp. 459-472.

Translation of the Examination Report, dated Aug. 15, 2013, from corresponding TW application.

* cited by examiner

*Primary Examiner* — Richard Crispino

*Assistant Examiner* — Dionne Walls Mayes

(74) *Attorney, Agent, or Firm* — Knobbe, Martens, Olson & Bear, LLP

(57) ABSTRACT

Oral smokeless tobacco products and oral smokeless non-tobacco snuff products include carbamide or carbamide salt (s). The carbamide salt is chosen from the group including carbamide calcium sulphate [$4(CH_4N_2O).CaSO_4$], carbamide magnesium sulphate [$6(CH_4N_2O).MgSO_4.2H_2O$] and carbamide sodium chloride [$CH_4N_2O).NaCl.H_2O$]. Moreover, carbamide or carbamide salt(s) are used in the manufacturing of oral smokeless tobacco products or oral smokeless non-tobacco snuff products.

8 Claims, 5 Drawing Sheets

Figure 1:
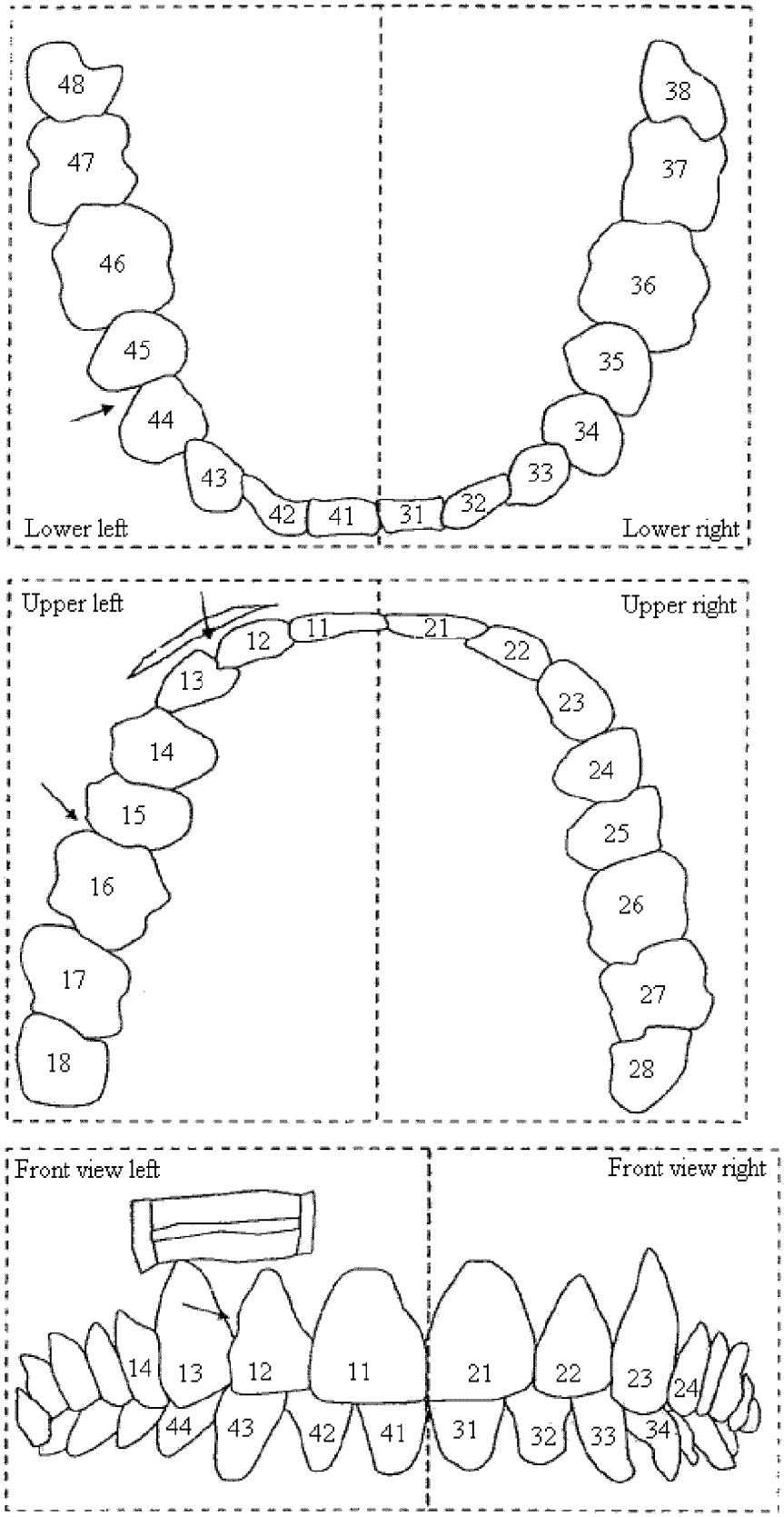

Low nic.#1, reference (no carbamide added). Site 12/13.

Low nic.#2, carbamide 0.5% (w/w of final product). Site 12/13.

Low nic.#3, carbamide 1.5% (w/w of final product). Site 12/13.

Chaw#1, reference (no carbamide added). Site 12/13.

Chaw#2, carbamide 0.5% (w/w of final product). Site 12/13.

Non-tob. Spread. #1, reference (no carbamide added). Site 12/13.

Non-tob. Spread. #2 carbamide 1% (w/w of final product). Site 12/13.

Non-tob. Spread. #2 carbamide 1% (w/w of final product). Site 15/16.

Non-tob. Spread. #2 carbamide 1% (w/w of final product). Site 44/45.

ORAL SMOKELESS TOBACCO PRODUCTS AND ORAL SMOKELESS NON-TOBACCO SNUFF PRODUCTS COMPRISING CARBAMIDE OR CARBAMIDE SALTS

FIELD OF INVENTION

The present invention relates to oral smokeless tobacco products and oral smokeless non-tobacco snuff products comprising carbamide.

BACKGROUND

Certain groups of facultative anaerobic microorganisms present on the surfaces of the tooth, called dental plaque, present in the form of a bio-film, are capable of metabolizing (fermenting) carbohydrates into organic acids, especially lactic acid. As a consequence, plaque-pH is lowered from 6.5-6.7 down to pH 4-5. At a pH of 6.0-6.2, the dentine of the tooth starts to degrade in a process known as "demineralization", where calcium and phosphate ions dissolve. Below a critical pH of 5.5-5.7, the enamel demineralises. When the acidity is neutralized to normal pH of 6.5-6.7 in the oral cavity, calcium and phosphate ions in the saliva are precipitating on the tooth surfaces. At supersaturation of the ions, the degraded areas are regenerated in a "remineralization" process. If the demineralization is too advanced for a successful remineralization to be obtained, caries lesions will occur. Consequently, frequent exposure to carbohydrates, resulting in a low pH in the oral cavity, may with time cause caries lesions. It is well known that the caries risk is lower if demineralization is avoided or if remineralization is stimulated.

Oral smokeless tobacco products are used in the oral cavity in direct contact with oral mucosa, where they are allowed to deliver flavor(s) and biologically active substances. The products are used in the mouth for an extended period of time, normally between 10 and 60 minutes and sometimes even longer. Typical oral smokeless tobacco products are for example moist snuff such as snus, and chewing tobacco, hard snuff and oral dry snuff.

Oral smokeless non-tobacco snuff products are products resembling oral smokeless tobacco products and are used in the same way as oral smokeless tobacco products.

Most oral smokeless tobacco products, as well as oral smokeless non-tobacco snuff products, contain carbohydrates. Tobacco naturally contains sugars and curing of the tobacco increases the sugar content as polysaccharides are broken down to sugar (mono- and disaccharides). Oral smokeless non-tobacco snuff products are usually based on plant materials which normally contain carbohydrates, such as sugars and starch. Oral smokeless tobacco products, as well as oral smokeless non-tobacco snuff products, may also have carbohydrates added to the raw material in the manufacturing process for improving the taste and/or texture of the product.

Generally, use of oral smokeless tobacco products as well as oral non tobacco snuff products, with high carbohydrate content, either naturally or by way of additives, and/or a low pH and/or a low buffer capacity, increases the risk of demineralization of the teeth.

It is known that repeated use of oral smokeless tobacco products as well as oral smokeless non-tobacco snuff products could cause gingival retraction and exposure of the root surface of teeth, likely as a consequence of mechanical stress. Since root surfaces are not covered by enamel, such surfaces are more prone to acid attacks of the dentine. As oral smokeless tobacco products as well as oral smokeless non-tobacco snuff products are used close to the teeth surfaces, it is of importance to prevent the teeth from demineralization possible to arise as a result of bacterial fermentation of carbohydrates originating from the products themselves, or other carbohydrates present in the oral cavity, during use of the products.

Hence, there exists a need for oral smokeless tobacco products and oral smokeless non-tobacco snuff products with an improved ability to counter-act demineralization of the teeth and/or the advent of caries lesions.

DESCRIPTION OF THE INVENTION

The present invention provides an oral smokeless tobacco product or an oral smokeless non-tobacco snuff product (herein below also referred to as the "product") by which the above-mentioned problems may be overcome. The oral smokeless tobacco product or the oral smokeless non-tobacco snuff product is defined in the appended claims. The product has caries-preventive properties. The product comprises carbamide, also known as "urea", and/or, carbamide salt(s). Examples of carbamide salts are carbamide calcium sulphate [$4(CH_4N_2O).CaSO_4$], carbamide magnesium sulphate [$6(CH_4N_2O).MgSO_4.2H_2O$] and carbamide sodium chloride [$CH_4N_2O).NaCl.H_2O$]. When not using pure carbamide for manufacturing of the product, but carbamide salts, the amount of the respective carbamide salt is advantageously chosen so that the equivalent amount of carbamide is released as would be released from the product if only neat carbamide was used. For the combination of carbamide and/or one or more salts thereof, an amount of each compound is added to the product so that the total level of carbamide desired to be available for release from the product is reached. Said group of carbamide and salts thereof is herein below collectively referred to as "carbamide", unless specifically defined otherwise.

Carbamide naturally occurs in small amounts in saliva and the bacterial constitutive enzyme urease hydrolyses it into ammonium carbonate and further into ammonia and carbon dioxide: [$(NH_2)_2CO+2H_2O \rightarrow (NH_4)_2CO_3 \rightarrow 2NH_3+H_2O+CO_2$]. The ammonia instantaneously reacts with any present acid, whereby teeth plaque-pH is increased. Ureolytic bacteria (i.e. bacteria capable of hydrolysing carbamide) are commonly found in the mouth and ureolytic activity has been demonstrated in saliva as well as in dental plaque. However, it has been shown that normal levels of acid in dental plaque from anaerobic decomposing of carbohydrates, is not totally inhibited by urea at concentrations likely to naturally occur in the oral cavity.

In accordance with the invention, an oral smokeless tobacco product or an oral smokeless non-tobacco snuff product releasing carbamide in the oral cavity is provided. Carbamide may be incorporated in the matrix of the product, for example in the tobacco or non-tobacco plant material mixture of the product. The oral use of the product, normally between gum and lip, implies that the matrix slowly will be soaked by the saliva. Subsequently carbamide, which is highly soluble, will be released into the oral cavity. Thus, carbamide will gradually leave the product to be transported to the dental plaque by saliva passing through the products' matrix. The concentration of carbamide will be the highest in areas close to where the product is placed, but the natural flow of saliva in the oral cavity will provide also distant dental sites with carbamide. Entering the outer layers of plaque, carbamide will instantaneously be broken down to carbon dioxide and ammonia by the bacterial enzyme urease. The ammonia will react with any present acid, whereby the plaque-pH is neutralized and even increases for the period of time the product is used. Hence, a carbamide releasing product with plaque-pH neutralizing properties is provided.

The long lasting tooth-protection, obtained in accordance with the current invention, ensures a plaque-pH neutralizing effect during the entire period of time the products are used in the mouth, or a substantial part thereof. The described effect not only protects the teeth from demineralization possibly caused by the oral smokeless tobacco product or the oral smokeless non-tobacco snuff product itself. The slow release of carbamide and the distribution of carbamide to distant sites in the oral cavity by the natural flow of saliva, also underlie the long-lasting caries-preventive properties of the products. Hence, for example oral smokeless non-tobacco snuff products with carbamide as an active ingredient, could be used for the purpose of protecting teeth from demineralization and caries lesions after e.g. the intake of a meal.

For products of the invention the long-term plaque-pH neutralizing effect and long-term elevation of plaque-pH has been confirmed in our in vivo studies of carbamide. Results show not only the rapid plaque-pH elevation effect of carbamide, but also that the delivery system in the shape of an oral smokeless tobacco product or an oral smokeless non-tobacco snuff product, provides the advantageous slow release of carbamide. The slow release of carbamide secures the delivery of carbamide to the plaque surfaces during the entire period of time the product is used in the mouth, and provides the long-lasting plaque-pH neutralization. In vivo studies have also shown that oral smokeless tobacco products and oral smokeless non-tobacco snuff products containing carbamide provide caries preventive effect not only directed to the dental sites close to where the product is placed but to a certain extent throughout the entire oral cavity. Typically, use of a 1 g oral smokeless non-tobacco product comprising 1% of carbamide for 60 minutes, has shown an increase in plaque-pH from 6.7 to 7.2 close to the oral site where the product is placed and from 6.7 to 7.0 in an oral site opposite the site where the product is placed. Consequently, the rapid, long-term and extensive plaque-pH neutralizing effect during use of oral smokeless tobacco products or oral smokeless non-tobacco snuff products with carbamide, proves the considerable advantage of incorporating carbamide to any oral smokeless tobacco products or oral smokeless non-tobacco snuff products with carbohydrates and/or a neutral or near-neutral pH and/or an absent or low pH buffering capacity. For the products comprising carbamide, the teeth will be protected from caries lesions possible to be caused by the products themselves. Furthermore, the important protection against demineralization of the dentine in exposed root surfaces and enamel will be provided.

A number of oral smokeless tobacco products may have a higher buffer capacity due to the nicotine content in the tobacco and may also have an alkaline pH. The latter may be typical for e.g. snus products. The buffer capacity and the alkaline pH of e.g. snus may compensate to a large extent for drop in pH in the oral cavity during use, which contributes of course to counteraction of demineralization of the teeth. However, addition of carbamide according to the invention into these products may further improve their ability of improving oral health, i.e., protection against demineralization and carries lesions, especially in connection with intake of e.g. a meal rich in carbohydrates.

The plaque-pH neutralizing properties brought by the slow release of carbamide during oral use of products of the invention, shows that there is an increase in pH close to the oral site where the product is placed. For oral smokeless tobacco products with carbamide, the elevated pH around the product will further force charged nicotine ions released from the tobacco to their unionized state. Hence, in accordance with the invention, there is provided an increase of the amount of nicotine available for absorption through the mucous membrane.

Carbamide-containing oral smokeless non-tobacco snuff products may also be used with the direct intention of them preventing demineralization and caries lesions of teeth. The purpose of the product is then two-fold: firstly to prevent the demineralization possibly caused by use of the product if the product is rich in carbohydrates and/or has a neutral or near-neutral pH and/or has an absent or low pH buffering capacity, and secondly to support neutralization of acids formed as a result of fermentation of carbohydrates originating from intake of e.g. food or drinks.

The content of carbamide, or the carbamide portion of the carbamide salt(s), as the case may be, of the final product, available for release in the oral cavity, may be in an amount of from 0.01% by weight (0.1 mg/g) to 20.0% by weight (200 mg/g), calculated as carbamide on total weight of the final product. Final product is herein used as meaning the finished product in condition to be packaged and marketed, having a moisture content characteristic of the respective product. The total weight of the final product is the sum of all dry and moist substances in the final product. The amount of carbamide may in an alternative embodiment be in the range of from 0.05% by weight (0.5 mg/g) to 6% by weight (60 mg/g), for example from 0.25% by weight (2.5 mg/g) to 2% by weight (20 mg/g), as calculated on total weight of the final product.

Any known type of oral smokeless tobacco or oral non-tobacco snuff product may be used in accordance with the invention. The products may be shaped into any suitable form and packaged in any desirable type of packaging.

The oral smokeless tobacco product may be e.g. moist snuff such as snus, or chewing tobacco, oral dry snuff or hard snuff. The oral smokeless non-tobacco snuff product may be shaped into a form resembling e.g. moist snuff such as snus, or chewing tobacco, oral dry snuff or hard snuff.

The moist snuff such as snus, or oral dry snuff, or alternatively the oral smokeless non-tobacco product shaped into a form resembling moist snuff such as snus, or oral dry snuff, may be in loose, particulate form or pre-packed.

The chewing tobacco, or alternatively the oral smokeless non-tobacco product shaped into a form resembling chewing tobacco, may be in loose-leaf form, in the form of a plug, roll or twist, or as cut pieces of a strand.

The hard snuff, or alternatively the oral smokeless non-tobacco product shaped into a form resembling hard snuff, may be in the form of a film, strip, pellet, pod, cake, stick, tablet or lozenge.

The oral smokeless tobacco product or oral smokeless non-tobacco snuff product may be packaged in a box, can, canister, cardboard box, bag, stick-pack wrapping, plastic wrapping, paper wrapping, foil wrapping, blisterpack or on a tray.

According to the present invention, there is also provided use of carbamide or carbamide salt(s), in the manufacturing of an oral smokeless tobacco product or an oral smokeless non-tobacco snuff product with caries-preventive properties.

Manufacturing processes of oral smokeless tobacco products, e.g. moist snuff such as snus, and chewing tobacco, are well known to the person skilled in the art, and any known process thereof may be used. Moist snuff is known as either Swedish-type snus or American-type moist snuff.

A general description of snus manufacturing is presented by e.g. ESTOC, European Smokeless Tobacco Council, and the GothiaTek quality standard for snus. Methods for the manufacture of American type moist snuff and chewing tobacco are described in e.g. 'Wahlberg, I., Ringberger, T. (1999) Smokeless Tobacco. In: *Tobacco: Production, Chemistry and Technology*, (eds D. L. Davis & M. T. Nielsen) pp. 452-460. World Agriculture Series, Blackwell Science Ltd. Tobacco is the raw material in any oral smokeless tobacco product. However, for the reason of controlling the nicotine content of the products, the raw material may well be constituted of a mixture of tobacco and other plant materials.

The principle of snus manufacturing is to mix ground or cut tobacco with water and sodium chloride and heat treating the mixture for a period of time long enough (typically several hours), and at a temperature high enough, to meet the demands for pasteurization. The heat treatment also gives texture and color to the mixture and enhances the natural tobacco flavors. After heat treatment the mixture is chilled. Additives such as pH-regulators and flavourings are then added and the mixture may be adjusted in moisture content. The ready-made blend is packed, typically in boxes as loose snus or as portions (pouches or sachets). Snus is typically used between the upper gum and lip and is well known as the Swedish-type of oral smokeless tobacco.

American-type moist snuff is commonly produced through a fermentation process of moisturized ground or cut tobacco. Flavors and ingredients are mixed to the blend and water is added to adjust the moisture content. American-type moist snuff is available in a loose form or as pre-packed pouches and is most commonly used between the lower gum and lip but could also be used as snus between the upper gum and lip.

Chewing tobacco is most often made of loose leaf tobacco, which is cured at a slightly elevated temperature. The tobacco leaves are then threshed into flakes and the mid-rids (stems) are removed. The tobacco fragments thus obtained are usually treated with a solution of flavors and additives, dried to lower the moisture content and packed in a consumer package. The product achieved is known as "loose-leaf chewing tobacco". The treated tobacco fragments could also be compressed to blocks of tobacco (product known as "plugs") or spun to thick strands of tobacco (product known as "twist"). For the Scandinavian type of chewing tobacco, the strands are thinner and cut into pieces. Chewing tobacco is normally used by putting a pinch of the loose leaf chewing tobacco or a bite of the plug or twist in the lower part of the mouth between the lower gum and lip. Scandinavian chewing tobacco, i.e. pieces of a strand, is normally used in the same way as snus. By chewing the tobacco once in a while, flavor is released more efficiently. Chewing tobacco as referred to here is the typical kind of chewing tobacco used in North America, commonly known as "chew" or "chaw", or Scandinavian chewing tobacco.

Hard snuff is a group of oral tobacco-based products intended for oral use as a delivery system of nicotine from tobacco. Besides the additive carrying the active substance, which is tobacco carrying nicotine, hard snuff products are generally constituted by entirely or substantially inert materials such as fibres and polymers. They may also be mainly constituted by powdered tobacco. Examples of hard snuff products are products in the shape of a film, strip, lozenge or tablet.

Dry oral snuff resembles snus and American-type moist snuff but is characterized by being made of a finely ground tobacco powder and having a low moisture content (typically less than 10%). The product may be heat treated but is normally manufactured from fire-cured fermented tobacco which is ground into a powder to which other ingredients such as flavors are added.

Manufacturing of oral smokeless non-tobacco snuff products typically follows the procedure of manufacturing of oral smokeless tobacco products, with the obvious difference that tobacco is replaced by non tobacco raw material, typically constituted of non-tobacco plant materials. Suitable plant materials are non-tobacco fibres, preferably characterized by having high dietary fibre content. Examples of such materials are oat fibres (dietary fibre content >85%), apple fibres (dietary fibre content approx. 50-60%), sugar beet fibres (dietary fibre content approx. 65-75%), potato fibres (dietary fibre content approx. 70%), corn fibres (dietary fibre content approx. 70-80%), buckwheat fibres (dietary fibre content approx. 90%), cocoa fibres (dietary fibre content approx. 50%), cellulose fibres (dietary fibre approx. 95-99%). Oral smokeless non-tobacco snuff products are used in the same manner as the corresponding oral smokeless tobacco products. They offer a healthier alternative to oral smokeless tobacco products, since they do not contain tobacco and most often do not contain any nicotine. In accordance with the invention, oral smokeless non-tobacco snuff products may also be used for the administration of drugs, as delivery systems intended for oral use and controlled release of biologically active substances.

To produce the oral smokeless tobacco product or oral smokeless non-tobacco snuff product according to the invention, carbamide may be added to the product mixture in any of the process steps of the manufacturing process. Carbamide may be added in its normal state as a white crystalline solid or as an aqueous solution. Preferably carbamide is added after the heat treatment or fermentation for the possibility to calculate the exact amount of carbamide to add to reach the desired content of carbamide in the final product. Care is taken to ensure that carbamide is not decomposed due to excessive heat. The person skilled in the art would realize at what process steps carbamide is most suitably added to the mixture. After addition of carbamide, the tobacco or non-tobacco blend must be mixed enough to have the carbamide homogeneously distributed in the blend.

The carbamide may also be added to the product in any other suitable manner of incorporating additives into smokeless products being known in the art.

The carbamide-containing blend may be packed in loose, particulate form, loose-leaf form, in the form of a pre-packed portion such as a pouch or sachet, in the form of a pellet, pod, cake, film, strip, tablet, lozenge or stick, as pieces of a strand or in the form of a plug or twist. The ready-made product may be packed in a consumer package such as a box, can, canister, cardboard box, bag, stick-pack wrapping, plastic wrapping, paper wrapping, foil wrapping, blisterpack or on a tray.

The present invention shall now be described with reference to accompanying figures and examples. The embodiments shall merely be seen as an illustration of the spirit and scope of the current invention, and in no way whatsoever as a limitation.

SHORT DESCRIPTION OF THE FIGURES

FIG. 1: Chart of permanent teeth with numbering according to the FDI two-digit system. Site 12/13 is marked as the site where plaque-pH is measured in Example 1-4. Site 15/16 and 44/45 are marked as the two additional sites for plaque-pH measurement in Example 4. The schematic pouch seen close to site 12/13 marks the upper jaw position where oral smokeless tobacco products and oral smokeless non-tobacco snuff products commonly are placed under the lip.

Figure 2:
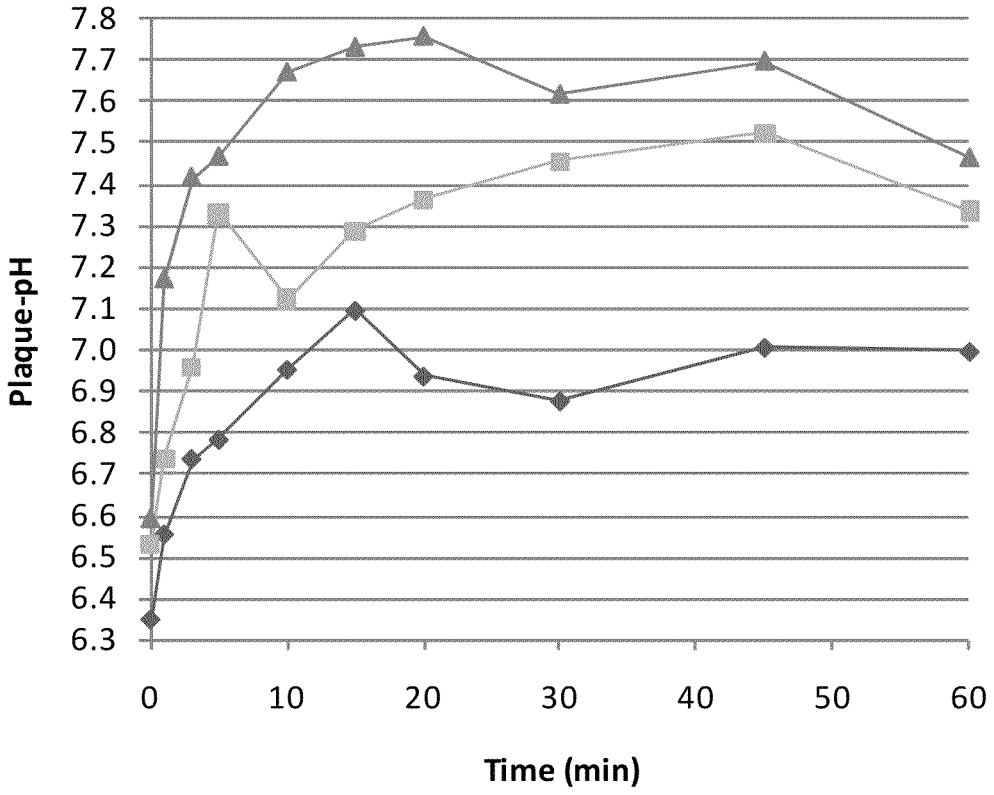

FIG. 2: Graph of plaque-pH in the anterior teeth in the upper jaw (site 12/13) during the use of portion-packed snus products placed under the lip. Products tested were one reference product (Low nic.#1) and two products with carbamide as an active ingredient; 0.5% (Low nic.#2) and 1.5% (Low nic.#3). pH at each time point (1, 3, 5, 10, 15, 20, 45 and 60 min) represents the average of three subjects.

Figure 3:
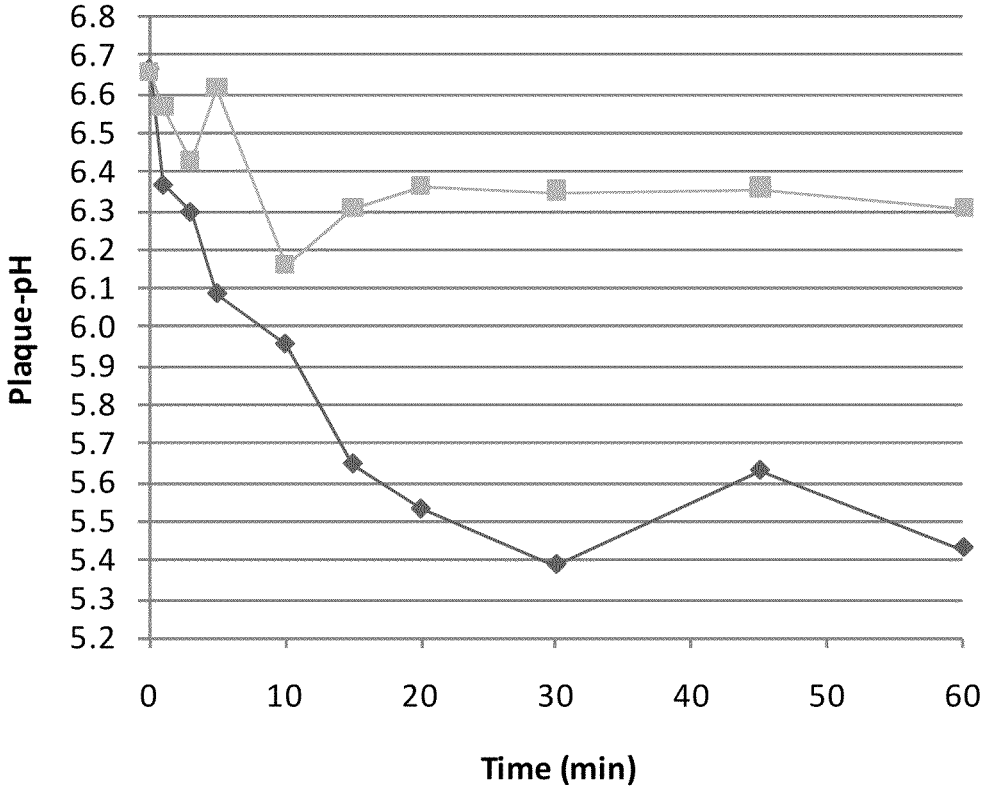

FIG. 3: Graph of plaque-pH in the anterior teeth in the upper jaw (site 12/13) during the use of pellet-formed loose-leaf chewing tobacco products placed under the lip. Products tested were one reference product (Chaw#1) and one product with carbamide as an active ingredient; 0.5% (Chaw#2). pH at each time point (1, 3, 5, 10, 15, 20, 45 and 60 min) represents the average of three subjects.

Figure 4:
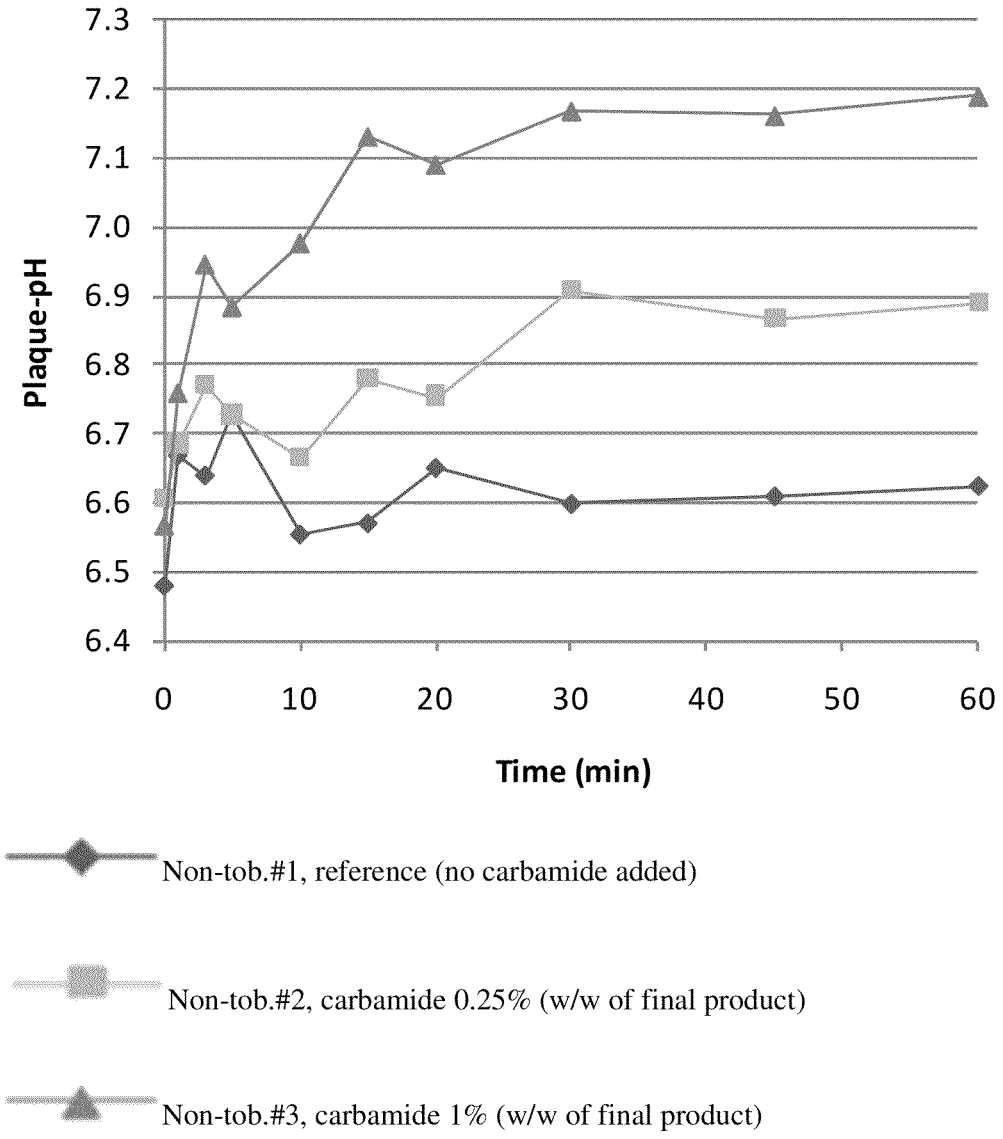

FIG. 4: Graph of plaque-pH in the anterior teeth in the upper jaw (site 12/13) during the use of portion-packed oral smokeless non-tobacco products placed under the lip. Products tested were one reference product (Non-tob.#1) and two products with carbamide as an active ingredient; 0.25% (Non-tob.#2) and 1% (Non-tob.#3). pH at each time point (1, 3, 5, 10, 15, 20, 45 and 60 min) represents the average of ten subjects.

Figure 5:
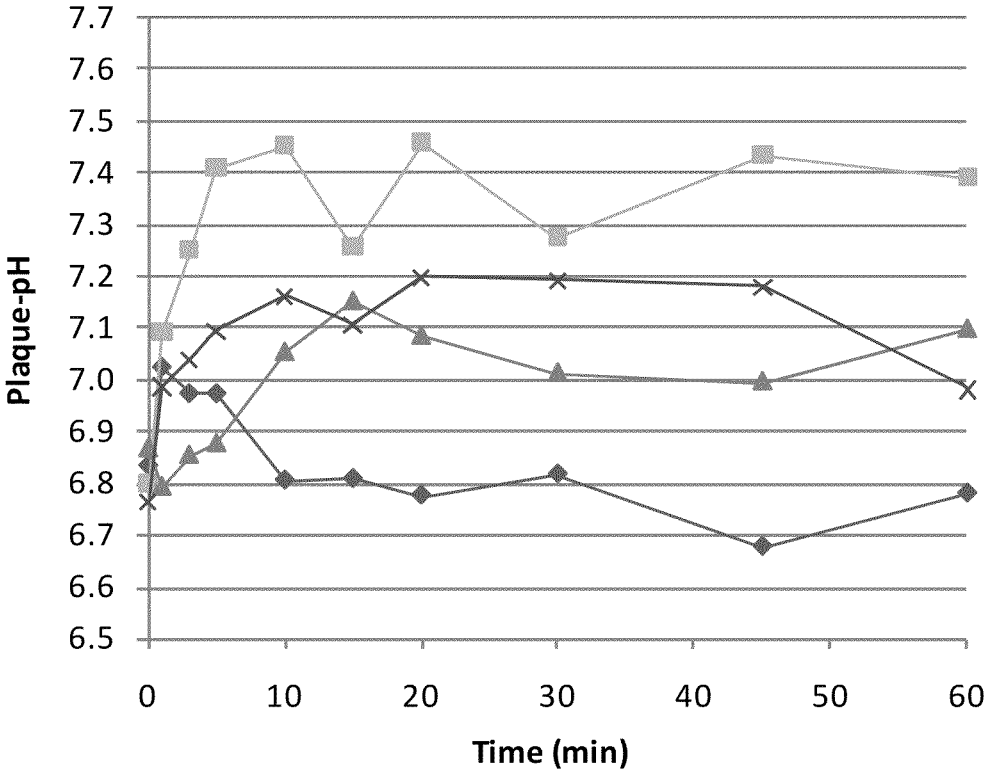

FIG. 5: Graph of plaque-pH in site 12/13, site 15/16 and site 44/45 during the use of portion-packed oral smokeless non-tobacco products placed under the lip. Products tested were one reference product (Non-tob. Spread. #1) and one product with 1% carbamide as an active ingredient (Non-tob. Spread. #2). The pH at each time point (1, 3, 5, 10, 15, 20, 45 and 60 min) represents the average of ten subjects.

METHOD

In order to prove the long-term effect of neutralization of acids and increase in plaque-pH during oral use of oral smokeless tobacco products and oral non-tobacco snuff products, a series of clinical tests have been carried out at Department of Cariology, University of Gothenburg. These tests involve use of a product according to the invention in the oral cavity, and simultaneous measuring plaque-pH in vivo with the MicroTouch method (Lingström et al. 1993). Adult subjects, with normal salivary secretion rate and buffer capacity, were recruited. They were asked to refrain from tooth brushing for 3 days before the test, to assure enough plaque on the tooth surfaces. The subjects were not allowed to eat or drink, or to use oral smokeless tobacco products or oral smokeless non-tobacco snuff products, within one hour before the test.

Plaque-pH was registered by inserting an iridium microelectrode (Beetrode® MEPH-1; W. P. Instruments, New Haven, Conn., USA) at various approximal dental sites. The approximal region, which is the surface of a tooth facing the adjacent tooth, is of special interest from a cariological point of view since it is a region were many individuals develop caries. For each subject, the same sites were used throughout the whole study, i.e. site 12/13 in the upper front region, close to where the product was placed, in all tests (Example 1-4), and sites 15/16 and 44/45 (additional sites in Example 4). The electrode was connected to an Orion SA 720 pH/ISE Meter (Orion Research, Boston, Mass., USA), equipped with a porous glass reference electrode (MERE 1; W.P. Instruments). A salt bridge was created in a 3 M KCl solution between the reference electrode and one of the subject's fingers. After measuring resting pH (0 min), the product was placed under the lip in the upper jaw close to site 12/13, which is a common way to use oral smokeless tobacco products and oral smokeless non-tobacco snuff products. Plaque-pH was then measured at eight different time points (1, 3, 5, 10, 15, 20, 45 and 60 min), while the product was kept in place during the whole 60-min test period. The subject was sitting in a dental chair and was not allowed to talk during the test.

EXAMPLES

Example 1

A Portion-Packed Low Nicotine Snus Product with Carbamide as a Biologically Active Ingredient A low nicotine snus-material was manufactured in accordance with the GothiaTek standard. It was a mixture of ground tobacco, sugar beet fibre, sodium chloride and water, which had been heat-treated at a temperature of 80° C. for 16 hours. After the heat-treatment, sodium carbonate was added to adjust the mixture to an alkaline pH and the mixture was then chilled to 17° C. Additional components were added to the chilled blend; calcium carbonate and sodium carbonate for pH adjustment, flavourings for a pleasant aroma and taste, water for moisture adjustment and carbamide as an active substance. Carbamide ($CH_4N_2O$, CAS#57-13-6, Sigma-Aldrich puriss grade 99.0-100.5%) was used in its solid state. As all ingredients were added, the blend was mixed to a homogenous mixture. Two blends were prepared with different carbamide content; one reference without carbamide was used. The total moisture content of the blends was around 30%.

The snus-blends were packed to portions using a standard stick-pack machine. A standard cellulose based non-woven fabric for snus was used as cover. The filled and sealed portions were sprayed with an aqueous solution of propylene glycol to have a final product of 1-g portions with a total moisture content of 50%. By the different additions of carbamide to the blends, the three final samples had carbamide content as shown in Table 1.

TABLE 1

Carbamide content in portion-packed low nicotine snus, used in the intra-oral plaque-pH test according to Example 1.

| | Portion weight (g) | Total moisture content (w/w) | Carbamide (mg/portion) | Carbamide (w/w of final product) |
|---|---|---|---|---|
| Low nicotine #1 (reference) | 1 | 50% | — | — |
| Low nicotine #2 | 1 | 50% | 5 | 0.5% |
| Low nicotine #3 | 1 | 50% | 15 | 1.5% |

The three samples were tested according to the plaque-pH method described in the Method section. Three adult subjects were recruited. Samples were placed under the lip in the upper jaw (site 12/13) and plaque-pH was measured in situ at eight different time points (1, 3, 5, 10, 15, 20, 45 and 60 min). The samples were kept in place during the entire 60-min test period. The graphs (FIG. 2) represent the average pH value of the three subjects for each time point.

Results

The graphs in FIG. 2 show the difference in plaque-pH between the reference sample without carbamide (Low nic.#1) and the two samples containing carbamide as an active ingredient; 0.5% (Low nic.#2) and 1.5% (Low nic.#3). Carbamide increases the speed of the initial rise in pH and moreover keeps the pH at a higher level throughout the whole 60-min period. The higher speed of initial pH and the higher pH during the entire test period for Low nic.#3 compared to Low nic.#2, indicates that there is a clear dose-response between pH and the amount of carbamide added. The lower curve shows pH of the reference sample without carbamide (Low nic.#1). It results in an initial increase of pH and that pH is kept at a high level (pH~7). Even though an oral smokeless tobacco product, when composed as the reference, would not cause a low pH in the oral cavity, and thus not constitute a caries risk for persons with normal oral hygiene, the higher pH from the samples containing carbamide proves that carbamide added to portion-packed low nicotine oral smokeless tobacco products gives a long-term protective effect against dental caries, which is especially beneficial for users with poor oral hygiene.

Example 2

Loose-Leaf Chewing Tobacco with Carbamide as a Biologically Active Ingredient In a chewing tobacco manufacturing process, a loose leaf chewing tobacco product was gathered prior to packing. It was split into two parts, of which one was kept as a reference (no carbamide added). A 10% (w/v) aqueous solution of carbamide (Sigma-Aldrich, ACS Grade, 99.0-100.5% Purity, CAS#57-13-6, CH4N2O) was prepared. 100 ml of the solution was added to 2000 g of the loose leaf chewing tobacco to prepare a chewing tobacco sample with 0.5% (w/w) carbamide. After addition of the carbamide-solution, the sample was mixed and placed in bag over night to equilibrate. Prior to packaging, the sample was mixed again. After packaging, the moisture content of the reference and the carbamide sample was analysed (Table 2).

TABLE 2

Carbamide content in loose-leaf chewing tobacco products used in the intra-oral plaque-pH test according to Example 2.

| | Test ration (g) | Total moisture content (w/w) | Carbamide (mg/test ration) | Carbamide (w/w of final product) |
|---|---|---|---|---|
| Chaw#1 (reference) | 1 | 26% | — | — |
| Chaw#2 | 1 | 26% | 5 | 0.5% |

The two samples were tested according to the plaque-pH-method described in the Methods section. Three adult subjects were recruited. For each sample, 1 g of the chewing tobacco material was formed by hand to the shape of a spherical porous pellet. The pellet was placed under the lip in the upper jaw (site 12/13) and plaque pH was measured at eight different time points (1, 3, 5, 10, 15, 20, 45 and 60 min). The samples were kept in place during the entire 60-min period. FIG. 3 represents the average pH value of the three subjects for each time point.

Results

The graphs in FIG. 3 show a decrease in plaque-pH for chewing tobacco without carbamide (reference, Chaw#1), caused by acid formation by fermentable carbohydrates. The pH drop was as low as 5.4 which increases the risk for dental caries both in enamel and dentine. The graph for Chaw#2 shows the pH-stabilizing effect of carbamide. The plaque-pH was kept above 6.2 throughout the period of time the product was used. These data indicates that chewing tobacco with carbamide added to a content of 0.5%, has a caries-preventive effect.

Example 3

A Portion-Packed Oral Smokeless Non-Tobacco Product with Carbamide as a Biologically Active Ingredient A non-tobacco based material was manufactured in accordance with the GothiaTek standard. The blend was a mixture of fibres from oat and cocoa bean, glycerol (humectant), sodium chloride and water, which had been heat-treated at 80° C. for 10 hours and chilled to 17° C. The heat treatment was carried out to reduce natural bacteria in the fibre raw material and to bring texture, colour, aroma and taste to the blend. Dry additives were mixed into the blend; sodium chloride, magnesium hydroxy carbonate, ammonium chloride and carbamide. Sodium chloride and ammonium chloride were added as taste enhancers and to lower the water activity of the blend. Sodium carbonate, added as an aqueous solution, and magnesium hydroxy carbonate, were added to adjust the blend to an alkaline pH. Carbamide (CH4N2O, CAS#57-13-6, Sigma-Aldrich puriss grade 99.0-100.5%) was added in its solid state. Flavourings were then added and the moisture content was adjusted to 46% by addition of water. Moisture content was verified by analysis. Finally, the blend was mixed to a homogenous mixture. One reference blend was prepared without carbamide (Non-tob.#1) and two blends were prepared with different carbamide content (Non-tob.#2 and Non-tob.#3).

The mixed materials were packed as 1-g non-woven covered portions using equipment for packaging of finely devided moistened materials into individual portion packages (U.S. Pat. Specification No. 6,135,120, "Device for packing of finely devided, moistened tobacco material", Löfman et al.). By the different additions of carbamide to the blends, the three final samples had carbamide content according to Table 3.

TABLE 3

Carbamide content in portion-packed oral smokeless non-tobacco products, used in the intra-oral plaque-pH test according to Example 3.

| | Portion weight (g) | Total moisture content (w/w) | Carbamide (mg/portion) | Carbamide (w/w of final product) |
|---|---|---|---|---|
| Non-tob. #1 (reference) | 1 | 44% | — | — |
| Non-tob. #2 | 1 | 44% | 2.5 | 0.25% |
| Non-tob. #3 | 1 | 44% | 10 | 1% |

The three samples were used by ten adult subjects in the plaque-pH-test (site 12/13). Thus, plaque-pH was measured at eight different time points (1, 3, 5, 10, 15, 20, 45 and 60 min). Graphs (FIG. 4) represent the average pH of the ten subjects.

Results

The lower graph in FIG. 4 shows that pH is around 6.6 for the reference sample throughout the 60-min test period. The curves of sample Non-tob.#2 and Non-tob.#3 show a clear increase of pH as carbamide is present. A dose-response effect was found, i.e. more carbamide resulted in higher pH. The steady pH at high levels for Non-tob.#2 and Non-tob.#3 proves that carbamide is released from the portion-packed oral smokeless non-tobacco products during the entire 60-min period and that the long-term effect of plaque-pH neutralization is provided.

Even though the reference sample without carbamide, which gives a plaque-pH of 6.6, would not be of caries risk for users with normal oral hygiene, the results prove that addition of carbamide to oral smokeless non-tobacco products increases the long-term effect of caries protection. The addition of carbamide is of special interest for caries risk persons with poor oral hygiene.

Example 4

Spreading Effect of Carbamide in the Oral Cavity

Portion-packed oral smokeless non-tobacco products were produced according to the manufacturing process described in Example 3. One sample was prepared as reference (Non-tob. Spread. #1) and one sample was prepared with carbamide (Non-tob. Spread. #2). The sample formulations are shown in Table 4.

TABLE 4

Carbamide content in portion-packed oral smokeless non-tobacco products, used in the intra-oral test with pH measurement at three different sites according to Example 4.

| | Portion weight (g) | Total moisture content (w/w) | Carbamide (mg/portion) | Carbamide (w/w of final product) |
|---|---|---|---|---|
| Non-tob. Spread. #1 (reference) | 1 | 44% | — | — |
| Non-tob. Spread. #2 | 1 | 44% | 10 | 1% |

The samples were tested in the plaque-pH test according to the described method, with ten adult subjects. pH was measured in the upper anterior site close to where the product was placed (site 12/13), the upper posterior site 15/16 and in the lower posterior site 44/45 (FIG. 1). The samples were kept in the same place throughout the 60-min test period and pH was measured at eight different time points (1, 3, 5, 10, 15, 20, 45 and 60 min). Graphs (FIG. 5) represent the average pH of the ten subjects.

Results:

The higher plaque-pH obtained from the sample with carbamide clearly shows the caries-preventive properties of carbamide in the site close to where the product is placed (FIG. 5). The pH-graphs of site 15/16 and site 44/45 prove that carbamide is spread in the oral cavity and causes an increase in pH also in the posterior sites. This indicates that oral smokeless tobacco or non-tobacco products with carbamide as an active substance have caries-preventive properties not only close to the site where the product is placed, but also in other sites in the oral cavity.

The invention claimed is:

1. An oral smokeless tobacco product, comprising tobacco and a carbamide salt, wherein said oral smokeless tobacco product is in a smokeless form selected from the group consisting of moist tobacco snuff, or snus, chewing tobacco, oral dry tobacco snuff, and hard tobacco snuff, and wherein the oral smokeless tobacco product comprises a carbamide salt selected from the group consisting of carbamide calcium sulphate $4(CH_4N_2O).CaSO_4$, carbamide magnesium sulphate $6(CH_4N_2O).MgSO_42H_2O$, and carbamide sodium chloride $CH_4N_2O).NaCl.H_2O$.

2. The oral smokeless tobacco product according to claim 1, wherein the carbamide portion of the carbamide salt is present in an amount of from 0.1 mg/g to 200 mg/g of the final product.

3. The oral smokeless tobacco product according to claim 1, wherein the carbamide portion of the carbamide salt is present in an amount of from 0.5 to 60 mg/g of the final product.

4. The oral smokeless tobacco product according to claim 1, wherein the carbamide portion of the carbamide salt is present in an amount of from 2.5 to 20 mg/g of the final product.

5. An oral smokeless nontobacco snuff product, comprising nontobacco plant materials and a carbamide salt, wherein the oral smokeless non-tobacco snuff product is in a smokeless form selected from the group consisting of moist non-tobacco snuff, or snus, non-tobacco chew resembling chewing tobacco, oral dry non-tobacco snuff, and hard non-tobacco snuff, and wherein the oral smokeless non-tobacco product comprises a carbamide salt selected from the group consisting of carbamide calcium sulphate $4(CH_4N_2O).CaSO_4$, carbamide magnesium sulphate $6(CH_4N_2O).MgSO_4.2H_2O$, and carbamide sodium chloride $CH_4N_2O).NaCl.H_2O$.

6. The oral smokeless non-tobacco product according to claim 5, wherein the carbamide portion of the carbamide salt is present in an amount of from 0.1 mg/g to 200 mg/g of the final product.

7. The oral smokeless non-tobacco product according to claim 5, wherein the carbamide portion of the carbamide salt is present in an amount of from 0.5 to 60 mg/g of the final product.

8. The oral smokeless non-tobacco product according to claim 5, wherein the carbamide portion of the carbamide salt is present in an amount of from 2.5 to 20 mg/g of the final product.

* * * * *